US009821196B2

(12) United States Patent
Lin

(10) Patent No.: US 9,821,196 B2
(45) Date of Patent: Nov. 21, 2017

(54) LUMINOUS BALL

(71) Applicant: Wei-Hung Lin, New Taipei (TW)

(72) Inventor: Wei-Hung Lin, New Taipei (TW)

( * ) Notice: Subject to any disclaimer, the term of this patent is extended or adjusted under 35 U.S.C. 154(b) by 0 days.

(21) Appl. No.: 15/242,511

(22) Filed: Aug. 20, 2016

(65) Prior Publication Data

US 2017/0065856 A1 Mar. 9, 2017

(30) Foreign Application Priority Data

Sep. 4, 2015 (TW) ..... 104214389 U

(51) Int. Cl.

| | |
|---|---|
| ***A63B 43/06*** | (2006.01) |
| ***A63B 69/00*** | (2006.01) |
| ***A63B 37/06*** | (2006.01) |
| *A63B 37/12* | (2006.01) |
| *A63B 102/18* | (2015.01) |

(52) U.S. Cl.

CPC ..... *A63B 43/06* (2013.01); *A63B 37/06* (2013.01); *A63B 69/0002* (2013.01); *A63B 2037/125* (2013.01); *A63B 2102/18* (2015.10); *A63B 2207/02* (2013.01)

(58) Field of Classification Search

CPC ..... A63B 43/06; A63B 43/00; A63B 43/008; A63B 43/004; A63B 37/12; A63B 2037/125

See application file for complete search history.

(56) References Cited

U.S. PATENT DOCUMENTS

| | | | | |
|---|---|---|---|---|
| 2,020,484 | A * | 11/1935 | Turner | A63B 43/06 362/190 |
| 3,011,048 | A * | 11/1961 | O'Brien | A63B 43/06 362/208 |
| 5,080,359 | A * | 1/1992 | Thill | A63B 43/008 273/DIG. 24 |
| 5,102,131 | A * | 4/1992 | Remington | A63B 43/06 428/11 |
| 5,609,411 | A * | 3/1997 | Wang | F21V 3/023 362/234 |
| 5,775,800 | A * | 7/1998 | Hsieh | A63B 43/06 362/295 |
| 6,142,894 | A * | 11/2000 | Lee | A63B 43/00 446/397 |
| 6,712,487 | B2 * | 3/2004 | Liou | A63B 37/0003 362/253 |

(Continued)

*Primary Examiner* — Steven Wong

(74) *Attorney, Agent, or Firm* — Li & Cai Intellectual Property (USA) Office

(57) ABSTRACT

A luminous ball is provided, including an internal sphere in which at least one receiving space is disposed; a light-emitting device disposed in the receiving space; at least one covering wrapping an external circumferential surface of the internal sphere; at least one seam formed on an edge of the covering; a plurality of thread apertures disposed in pairs at two sides of the at least one seam; at least one thread penetrating the plurality of thread apertures to stitch the edge of the covering between the two sides of the at least one seam; wherein the internal sphere is a transparent ball, a light generated by the light-emitting device penetrates the internal sphere through the receiving space, and is visible through the at least one seam and the plurality of the thread apertures distributed on the covering.

9 Claims, 9 Drawing Sheets

(56) References Cited

U.S. PATENT DOCUMENTS

| | | | | |
|---|---|---|---|---|
| 7,048,656 | B2 * | 5/2006 | Litchfield | A63B 37/12 473/598 |
| 2001/0049311 | A1 * | 12/2001 | Lewis | A63B 43/06 473/570 |
| 2003/0027671 | A1 * | 2/2003 | Kuhn | A63B 37/14 473/597 |
| 2005/0096157 | A1 * | 5/2005 | Huang | A63B 37/0003 473/351 |
| 2005/0261083 | A1 * | 11/2005 | Liao | A63B 24/0021 473/353 |
| 2007/0021244 | A1 * | 1/2007 | Ko | A63B 43/06 473/570 |
| 2014/0256478 | A1 * | 9/2014 | Gale | A63B 43/004 473/465 |
| 2014/0277636 | A1 * | 9/2014 | Thurman | A63B 24/0021 700/91 |
| 2015/0159846 | A1 * | 6/2015 | Hollinger | H05B 33/0806 362/183 |
| 2015/0159858 | A1 * | 6/2015 | Lin | F21V 33/008 362/551 |
| 2016/0271458 | A1 * | 9/2016 | Lin | A63B 43/06 |
| 2016/0354665 | A1 * | 12/2016 | Greenwalt | A63B 69/0002 |

* cited by examiner

LUMINOUS BALL

BACKGROUND

1. Technical Field

The present disclosure relates to a luminous ball, in particular, to a luminous ball adapted to be employed in the baseball/softball game.

2. Description of Related Art

Ball games can always attract the sports enthusiasts' interest. Baseball, for example, has a long history and is well-known to the public, and the professional baseball leagues of the US and Asia both have a lot of loyal fans all over the world. It thus goes without saying that baseball is one of the most popular sports, because baseball is easy to play. Pitching and catching the baseball can meet the user's satisfaction for entertainment or for the purpose of exercise.

Baseball games are usually held in the professional baseball stadiums. However, when the people want to play it for fun, they are unlikely to be able afford an expensive indoor or outdoor facility. Generally, people have time to do exercise after work, which is usually at night. But compared with the other sports such as basketball, badminton, soccer, and so on, playing a baseball game without having the lighting apparatus or sufficient light source is dangerous because of the hardness of the baseball. As a rule the regular baseball has a greater hardness than the other balls, so the baseball players have to wear protectors when having a baseball game. If people want to pitch and catch the baseball at night or after darker hours of the evening, it is possible to cause damage to the user's body because of the fastball and the hardness of the baseball. Thus the lighting apparatus or a sufficient light source is indispensable to play baseball. As far as the amateur baseball players are concerned, it is not economical to afford a professional baseball field. However, it is a risk to have a baseball game under the reduced lighting conditions or without the lighting apparatus or sufficient light source.

Currently, there are several luminous balls provided for the night-time use, and those balls are usually coated with the fluorescent materials on the surface of the ball or disposed with the fluorescent components in the ball to enable the user to recognize and identify the movement of the luminous ball at night. However, the fluorescent materials are easy to peel off during the ball game and the luminous ability decreases with time, and the service life of the fluorescent components is short. In addition, the user cannot promptly recognize and identify the luminous ball coated with the fluorescent materials or disposed with the fluorescent components because the fluorescent materials can only radiate weak light. Relative to the speed of the baseball, the human's reaction time is incapable of responding to a fastball quickly. As to the fluorescent materials, whenever the user uses the luminous ball coated with the fluorescent materials, the residue of fluorescent materials is harmful to the health.

When having a baseball/softball game, the players need to have professional skills to play and enjoy it because the regular baseball/softball has its own appearance, weight and hardness which differ from the other ball games. If the specification of baseball/softball fails to meet the standards, the players, including the pitcher, catcher and fielders may all be affected by the defective ball.

In order to achieve the best effect on playing, each baseball/softball has to be made in compliance with the standard specification, so that the formal ball game is not affected by the defective ball. However, the conventional luminous ball is disposed with light-emitting components, causing the differences in the structure, material, weight and hardness of the ball. As to the luminous ball coated with the fluorescent materials on the surface thereof or disposed with the fluorescent components in the ball, the specification of the ball changes and therefore differs from the regular baseball/softball, and the changes and differences may negatively affect the players. Thus a baseball/softball that does not have the standard specification cannot be employed in a formal ball game.

In view of the aforementioned shortcomings, the present disclosure provides a luminous ball to resolve it.

SUMMARY

An exemplary embodiment of the present disclosure provides a luminous ball similar to a baseball/softball in appearance and batting impact, and adapted to night-time use.

According to one exemplary embodiment of the present disclosure, a luminous ball is provided, including an internal sphere in which at least one receiving space is disposed; a light-emitting device disposed in the receiving space; at least one covering wrapping an external circumferential surface of the internal sphere; at least one seam formed on an edge of the covering; a plurality of thread apertures disposed in pairs at two sides of the at least one seam; at least one thread penetrating the plurality of thread apertures to stitch the edge of the covering between the two sides of the at least one seam; wherein the internal sphere is a transparent ball, a light generated by the light-emitting device penetrates the internal sphere through the receiving space, and is visible through the at least one seam and the plurality of the thread apertures distributed on the covering.

In a preferred embodiment of the present disclosure, the seams and the threads are distributed on the covering of the luminous ball in accordance with the red threads distributed on a regular baseball/softball.

In a preferred embodiment of the present disclosure, the internal sphere is made of a transparent elastic material.

In a preferred embodiment of the present disclosure, a hollow part is disposed in the internal sphere, and a plurality of concave parts are disposed on an internal side surface of the hollow part in the internal sphere.

In a preferred embodiment of the present disclosure, the internal sphere includes at least two elastic layers having different elastic coefficients, and the least two elastic layers are concentrically covered with each other to form the internal sphere.

In a preferred embodiment of the present disclosure, the light-emitting device is an LED device.

In a preferred embodiment of the present disclosure, the light-emitting device is a fluorescent light-emitting device.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification.

The drawings illustrate exemplary embodiments of the present disclosure and, together with the description, serve to explain the principles of the present disclosure.

DESCRIPTION OF THE EXEMPLARY EMBODIMENTS

Figure 1:
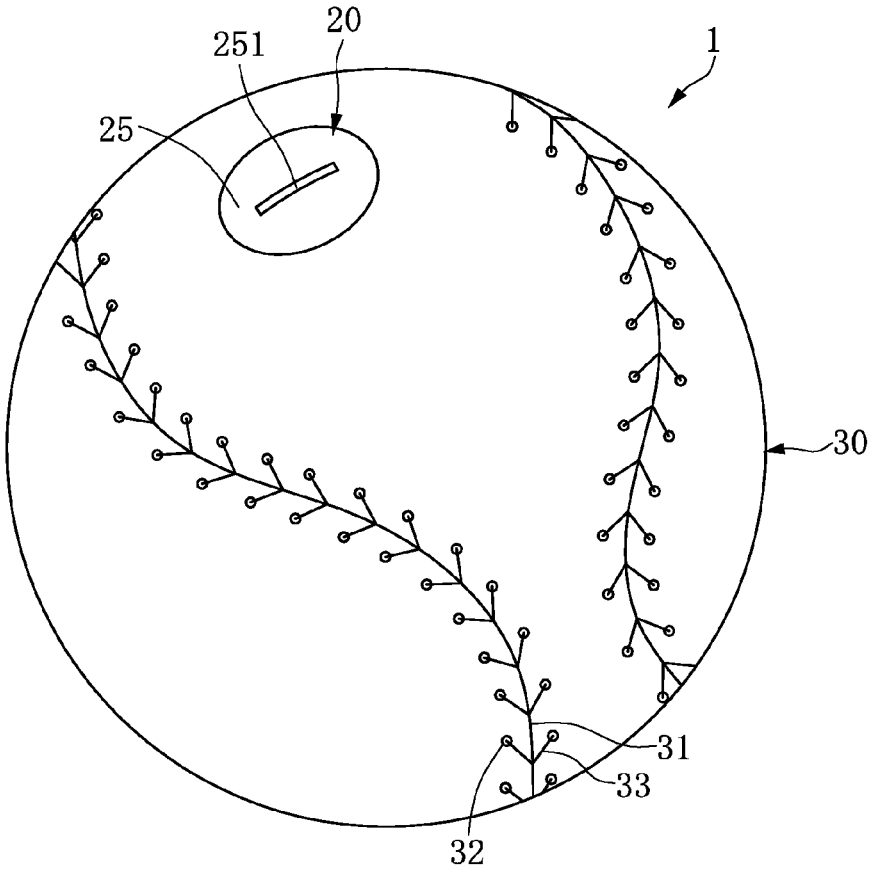
FIG. 1 is a three-dimensional diagram of the first embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

The present disclosure provides a luminous ball 1 which is similar to the regular baseball/softball in appearance and suitable to be employed under reduced lighting conditions such as dim light at night and for night-time use.

Figure 2:
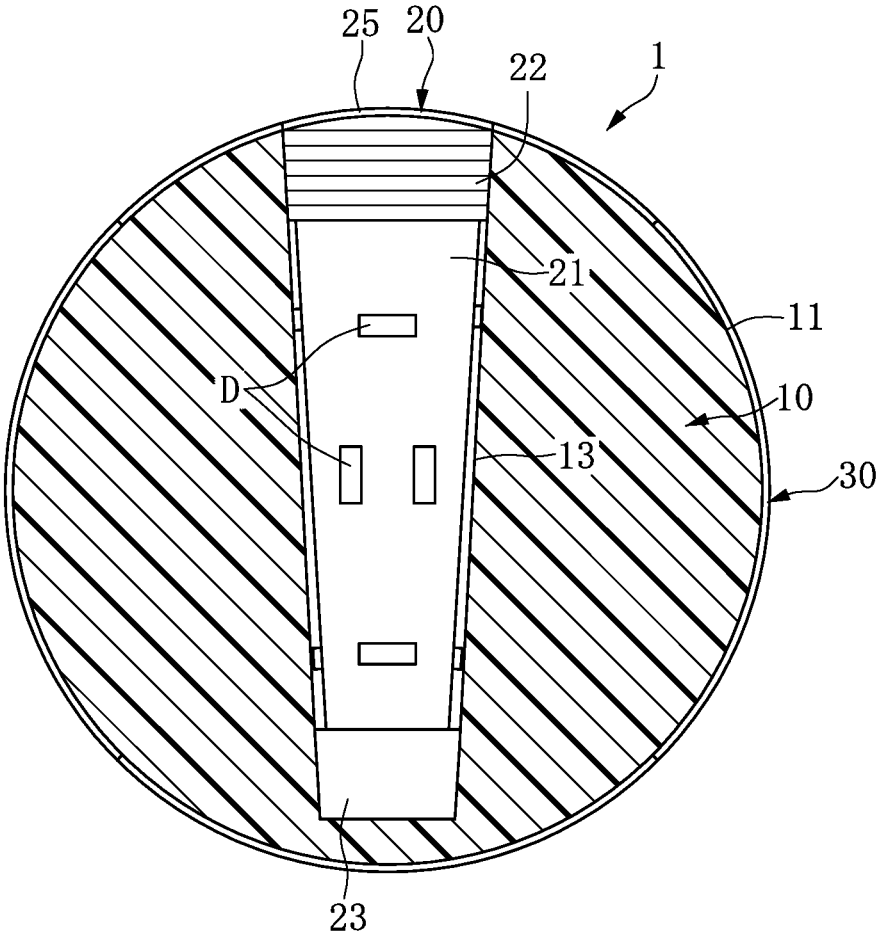
FIG. 2 is a sectional diagram of the first embodiment of the present disclosure.

Please refer to FIG. 1 and FIG. 2. The luminous ball 1 provided by the present disclosure includes an internal sphere 10, at least one covering 30 wrapping an external circumferential surface of the internal sphere 10, and a light-emitting device 20 disposed in the internal sphere 10, wherein the internal sphere 10 is made of a light transmissive material. A receiving space 13 is disposed in the internal sphere 10 for receiving the light-emitting device 20.

Figure 3:
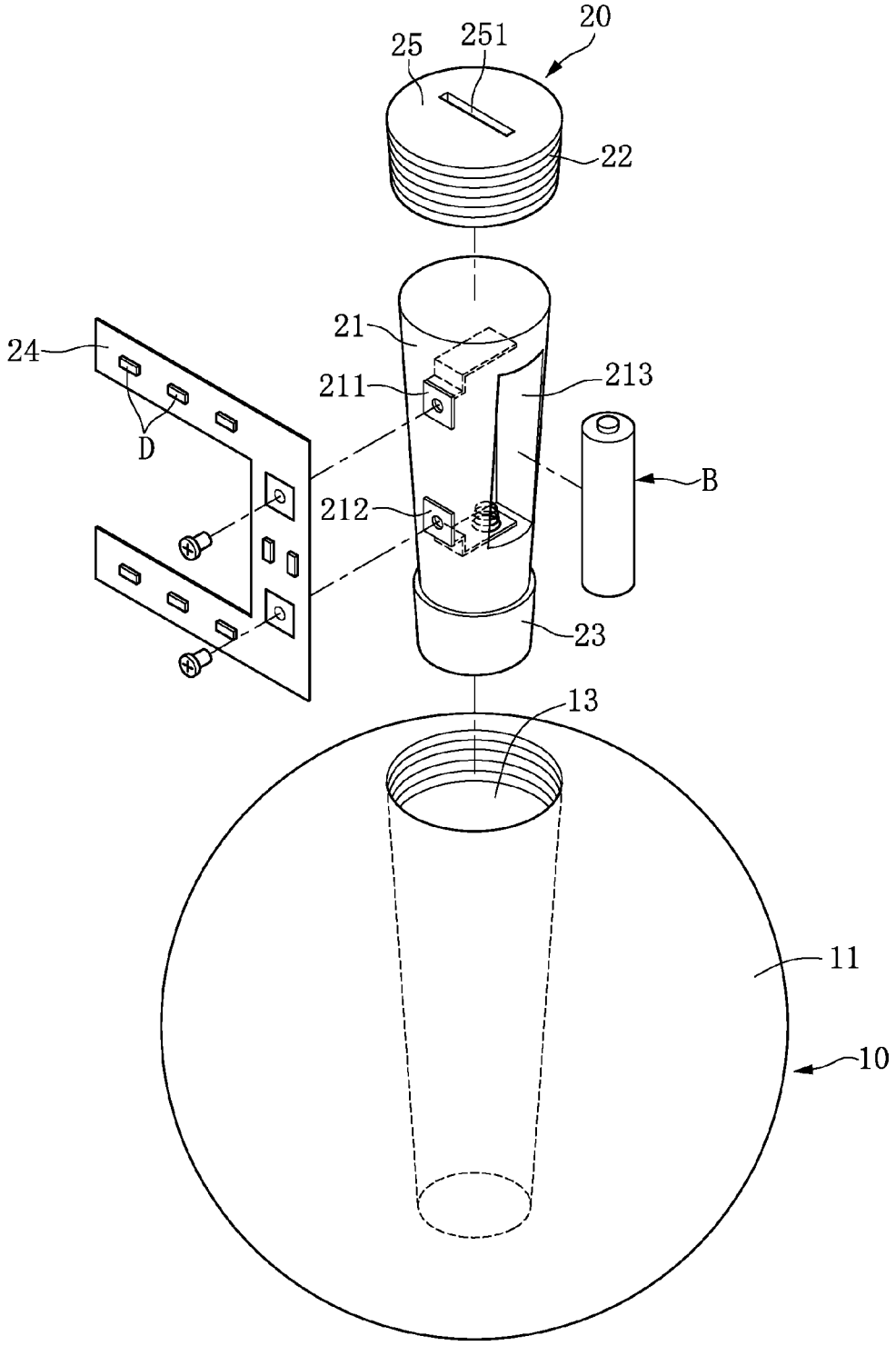
FIG. 3 is an exploded view of the internal sphere and the light-emitting device of the first embodiment of the present disclosure.

As shown in FIG. 1, FIG. 2 and FIG. 3, the internal sphere 10 has an external circumferential surface 11, and the at least one covering 30 wraps the external circumferential surface 11 of the internal sphere 10. Ends of the at least one covering 30 are spliced to each other to completely wrap the external circumferential surface 11 of the internal sphere 10. At least one seam 31 is formed on an edge of the at least one covering 30 and distributed in a meandering course. A plurality of thread apertures 32 are disposed in pairs at two sides of the at least one seam 31, and at least one thread 33 is provided to penetrate the plurality of thread apertures 32 to stitch the edge of the covering 30 between the two sides of the at least one seam 31 to enable the at least one covering 30 to wrap the external circumferential surface 11 of the internal sphere 10. As shown in FIG. 1 and FIG. 2, the plurality of thread apertures 32 are disposed in pairs at two sides of the seam 31 on the covering, and the at least one thread 33 penetrates the plurality of thread apertures 32.

The primary technical feature of the present disclosure is that the luminous ball is similar to the regular baseball/softball in appearance and has the same batting impact as the regular baseball/softball. To achieve the purpose, the genuine leather which is similar or identical with the regular baseball/softball is used to wrap the circumferential surface of the internal sphere 10 of the luminous ball 1 of the present disclosure. In addition, as shown in FIG. 1, the seam 31 is distributed on the covering 30 of the luminous ball 1 of the present disclosure in accordance with the meandering course of the red thread distributed on the regular baseball/softball, and the at least one thread 33 which is stitched on the covering 30 of the luminous ball 1 is also the same as the standard baseball/softball. Thus the luminous ball 1 of the present disclosure and the regular baseball/softball have the same features in terms of the hardness, thickness, grain strength, tensile strength, and resiliency and so on, thereby enabling the luminous ball 1 to be employed in formal baseball/softball games or training.

Figure 4:
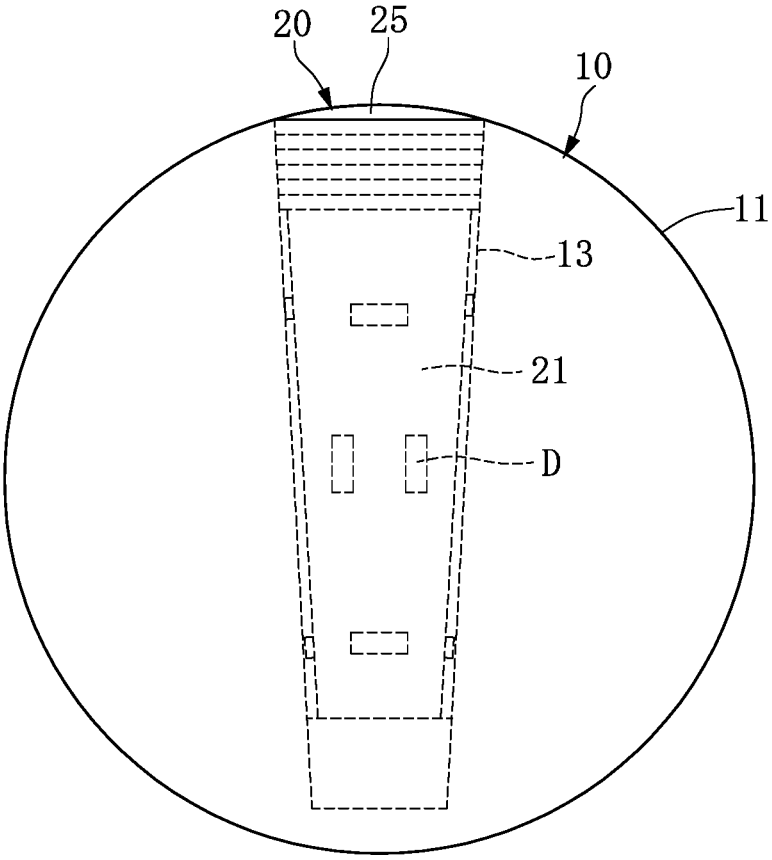
FIG. 4 is a side view of the internal sphere and the light-emitting device of the first embodiment of the present disclosure.

As shown in FIG. 3 and FIG. 4, the light-emitting device 20 includes a main body 21 and a plurality of light-emitting diodes D disposed on the main body 21. In the present embodiment, the main body 21 is a tapered rod. Preferably, the main body 21 can be made according to the shape of the receiving space 13 of the internal sphere 10, so that the main body 21 can be received in the receiving space 13. A top opening of the receiving space 13 is disposed with an internal screw part. A cap 25 is provided, and a side surface of the cap 25 has a screw part 22 which enables a bottom of the cap 25 to be fixed in the receiving space 13 when the cap 25 is rotated in the receiving space 13. When the cap 25 has been fixed in the receiving space 25, a height of the cap 25 is slightly higher than the circumferential surface of the internal sphere 10 to form a protrusion. When the covering 30 wraps the circumferential surface of the internal sphere 10, the protrusion of the cap 25 is wrapped by the covering 30. Here, before the wrapping, a hole corresponding to the position and size of the cap 25 is reserved, so that the cap 25 can be exposed by the hole when the covering 30 has wrapped the circumferential surface of the internal sphere 10. The reserved hole also has the same radian as the covering 30. In addition, a slot 251 is disposed on the cap 25 to facilitate the user to fix the cap 25 in the receiving space 13 or to remove the cap 25 from the receiving space 13, thereby enabling the user to insert the light-emitting device 20 in the receiving space 13 or to remove the light-emitting device 20 from the receiving space 13.

A lower end of the main body 21 of the light-emitting device 20 includes a lower connection part 12 connected to the lower end of the main body 21 and capable of being fixed at the bottom of the receiving space 13. The lower connection part 23 cooperates with the bottom of the receiving space 13 to fix the light-emitting device 20 in the receiving space 13. In a preferred embodiment, the lower connection part 23 and the receiving space 13 can be formed as a coupling structure to provide the user with the mistake-proofing function, thereby ensuring the light-emitting device 20 to be disposed in the receiving space 13 at a predetermined angle and direction. Thus the light-emitting device 20 can emit light through the receiving space 13 according to the predetermined angle and direction to enable the luminous ball to produce the optimal luminous efficiency.

In addition, the light-emitting device 20 further includes a soft printed circuit board 24 on which the plurality of light-emitting diodes D and a control circuit used to control the plurality of light-emitting diodes D are disposed. The printed circuit board 24 is disposed on an external wall of the main body 21, and electrically connected to a first electrode sheet 211 and a second electrode sheet 212 which are respectively disposed on an external side wall of the main body 21. A middle portion of the main body 21 is disposed with a battery container 213 used to contain a battery B. The first electrode sheet 211 and the second electrode sheet 212 penetrate the main body 21 and extend to the battery container 213, and are embedded on the external wall of the main body 21. The first electrode sheet 211 and the second electrode sheet 212 are electrically connected to the battery B.

The light-emitting device 20 is a preferred embodiment applied to the present disclosure, but not limited thereto.

As shown in FIG. 3 and FIG. 4, the printed circuit board 24 is disposed to surround the external wall of the main body 21, and the plurality of light-emitting diodes D is disposed on the external wall of the main body 21. When the main body 21 of the light-emitting device 20 has been disposed in the receiving space 13 of the internal sphere 10, the light is emitted outwardly to the external wall of the main body 21 by the plurality of light-emitting diodes D, and then penetrates the internal sphere 10.

As shown in FIG. 2, the internal sphere 10 and the covering 30 are combined to form the luminous ball 1 which has the same appearance as a regular baseball/softball. As the internal sphere 10 is made of the light transmissive material, the light emitted by the light-emitting device 20 can penetrate the internal sphere 10. As the covering 30 is made of an opaque genuine leather material, the light is incapable of penetrating the covering 30. Because there is at least one seam 31 and thread aperture 32 disposed on the covering 30, the light is visible through the at least one seam 31 and thread aperture 32. By means of the seam 31 and thread aperture 32, the luminous ball of the present disclosure is suitable to be employed in dim light at night and for night-time use. In addition, the user can clearly see the motion trajectory and rotation path of the luminous ball 1 through the light which is visible through the seam 31 and thread aperture 32 of the luminous ball 1.

The user can recognize and identify the motion trajectory and rotation path of the luminous ball 1 in the darker hours in the evening because of the light which is visible through the seam 31 and thread aperture 32. It is known that whether or not a professional baseball/softball player swings the baseball bat to hit the ball depends on the ball's motion trajectory and rotation path, and thus, the visible light through the seam 31 and thread aperture 32 of the luminous ball 1 of the present disclosure enables the user to play a ball game and to pitch and catch the ball without being affected by the reduced lighting conditions.

The internal sphere 10 applied in the first embodiment is made of the transparent elastic material, but not limited thereto. In order to meet the standards of the regular baseball/softball, the luminous ball 1 of the present disclosure can use the same diameter and material as the regular baseball/softball, so that the internal sphere 10 of the luminous ball 1 can have the same weight and elastic coefficient as the regular baseball/softball.

According to the above-mentioned technical features, the luminous ball 1 of the present disclosure has the same appearance as the regular baseball/softball and meets the standard specification of the regular baseball/softball. In addition, by means of the light that is visible through the seam 31 and thread aperture 32, the user can easily recognize and identify the motion trajectory and rotation path of the luminous ball 1 under the reduced lighting conditions. Thus, the luminous ball of the present disclosure can be feasibly applied in the dim light and darker hours in the evening, and can be adapted to night-time use.

Figure 5:
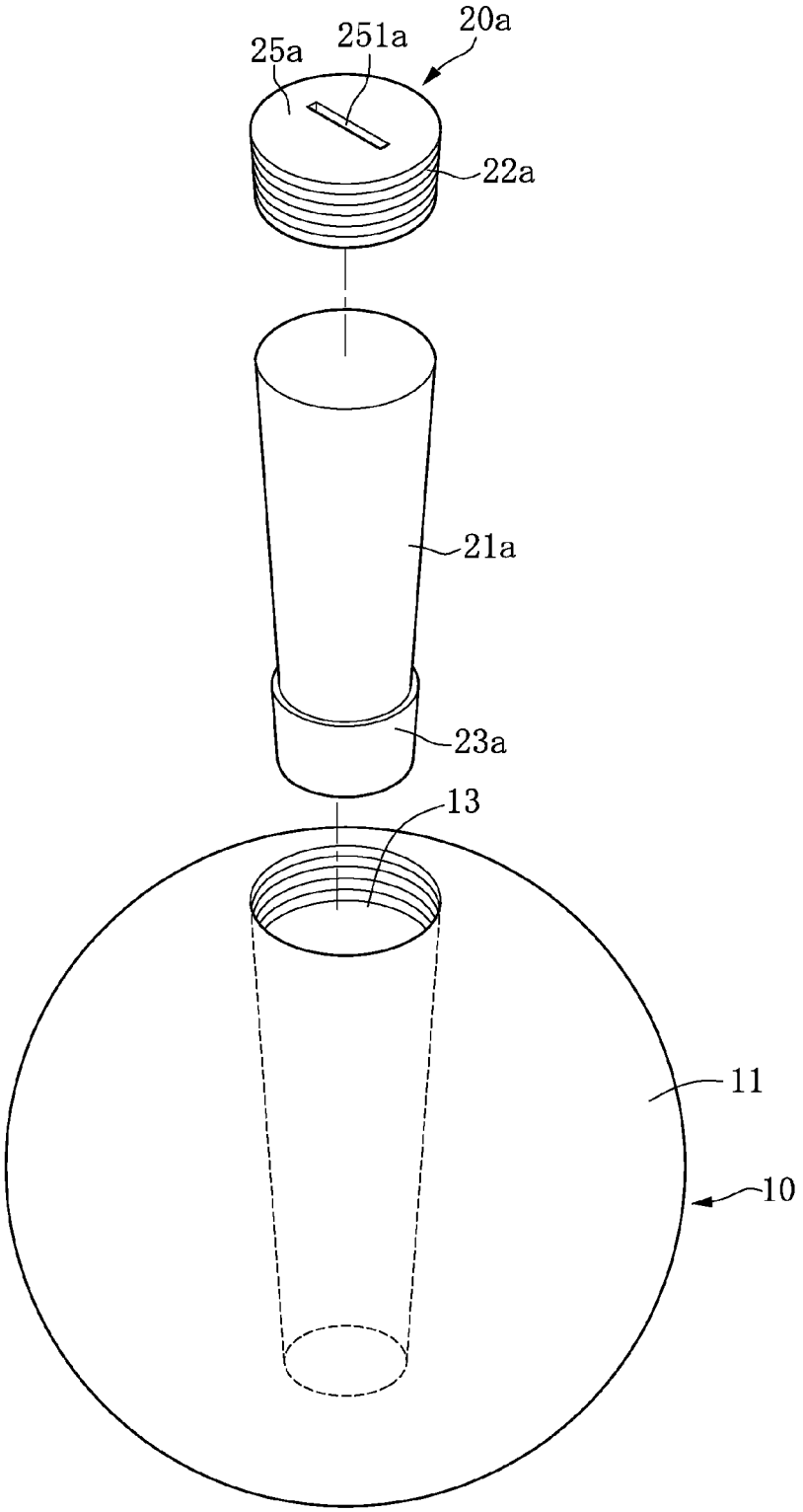
FIG. 5 is an exploded view of the internal sphere and the light-emitting device of the second embodiment of the present disclosure.

FIG. 5 illustrates the second embodiment of the present disclosure. The difference between the first and the second embodiments is that the light-emitting device 20 applied in the first embodiment is replaced by a fluorescent light-emitting device 20*a*. The fluorescent light-emitting device 20*a* includes a fluorescent column 21*a*, a cap 25*a* and a lower connection part 23*a*. A diameter of the fluorescent column 21*a* tapers from an upper to a lower thereof. The cap 25*a* is used to cover and then lock an opening of the receiving space 13, a bottom of the cap 25*a* is connected to an upper end of the fluorescent column 21*a*, and the lower connection part 23*a* is connected to a lower end of the fluorescent column 21*a* and couples with the bottom of the receiving space 13.

The fluorescent column 21*a* is self-illuminated because it is a fluorescent rod. However, the fluorescent column 21*a* is not durable. When the fluorescent light generated by the fluorescent column 21*a* gradually disappears or is not clearly visible, the user can unlock the cap 25*a* through the slot 251*a*by using a specific tool, and then take the fluorescent column 21*a* out of the receiving space 13 of the internal sphere 10 to replace a new fluorescent column 21*a*.

Here, any type of light-emitting device can be feasibly applied to the luminous ball 1 disclosed in the second embodiment, and the present disclosure is not limited thereto.

Figure 6:
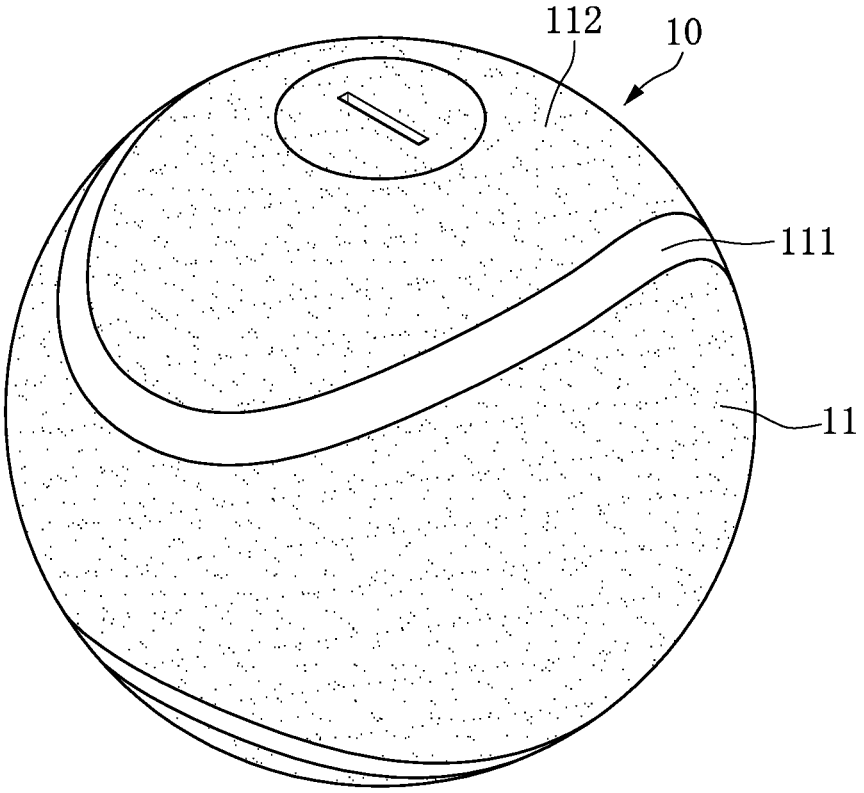
FIG. 6 is a three-dimensional diagram of the third embodiment of the present disclosure.

Please refer to FIG. 6 which is the third embodiment of the present disclosure. The difference between the present embodiment and the former embodiments is that the external circumferential surface 11 of the internal sphere 10 includes a smooth surface 111 and a rough surface 112 adjacent to the smooth surface 111, wherein the smooth surface 111 is distributed on the external circumferential surface 11 of the internal sphere 10 in accordance with the meandering course of the seam 31 distributed on the covering 30, and a width of the smooth surface 11 at least covers a width of the seam 31 and the thread aperture 32.

The rough surface 112 is distributed on a surface area of the internal sphere 10 where is not covered by the smooth surface 111, wherein the rough surface 112 may be treated by grinding or sandblasting to increase the adhesion between the covering 30 and the internal sphere 10. And alternatively, when forming the internal sphere 10, an internal surface of the forming mold used to form the internal sphere 10 which corresponds to the rough surface 112 can be disposed with the sandpaper to roughen the rough surface 112 to increase the adhesion between the covering 30 and the internal sphere 10.

Figure 7:
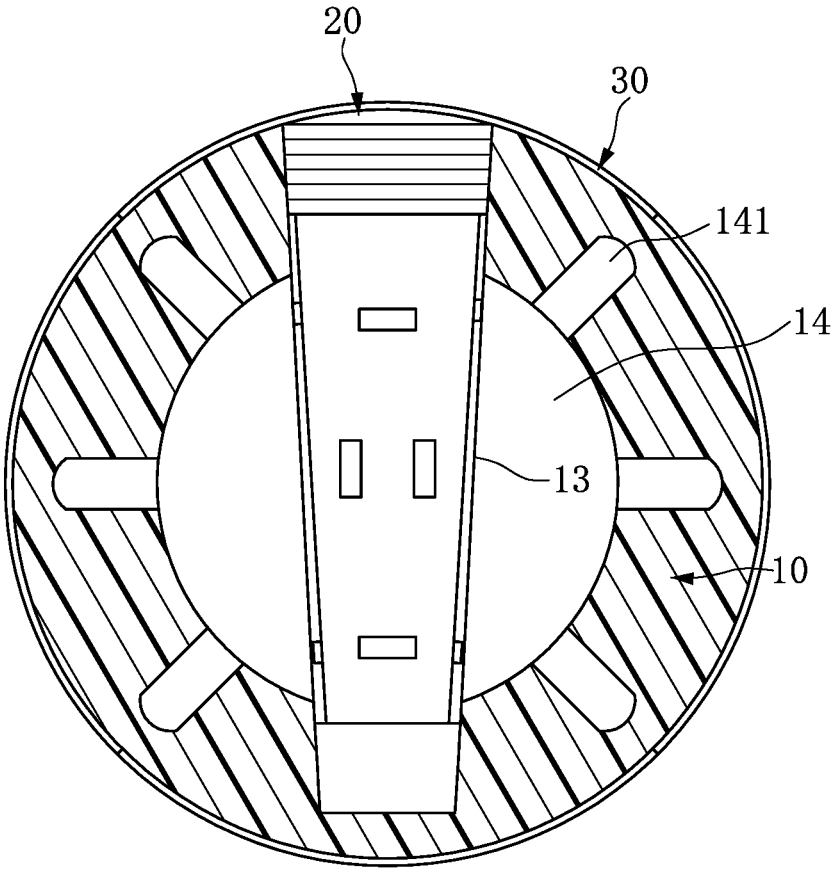
FIG. 7 is a sectional diagram of the fourth embodiment of the present disclosure.

FIG. 7 illustrates the fourth embodiment of the present disclosure. In the present embodiment, a hollow part 14 is disposed in the central portion of the internal sphere 10, wherein the hollow part 14 is used to adjust the weight and elastic force of the internal sphere 10, thereby enabling the internal sphere 10 to have the weight and elastic force that are the same as the regular baseball/softball.

In addition, an internal side surface of the hollow part 14 is disposed with a plurality concave parts 141 used to adjust the weight and elastic force of the internal sphere 10 more precisely.

Figure 8:
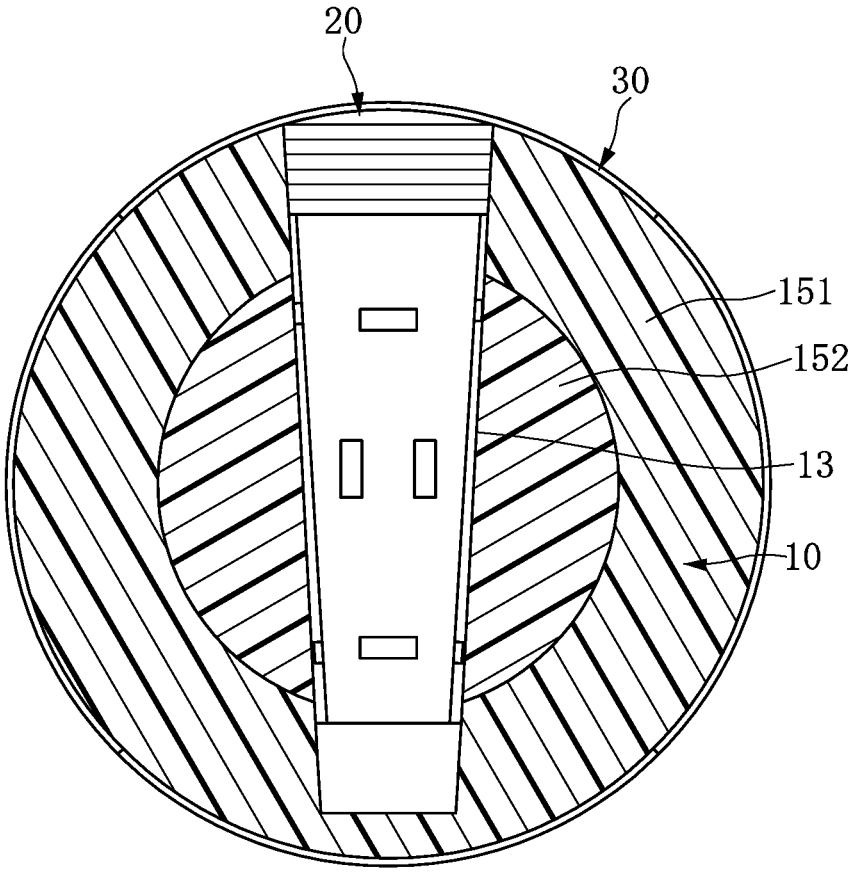
FIG. 8 is an exploded view of the fifth embodiment of the present disclosure.

FIG. 8 illustrates the fifth embodiment of the present disclosure. In the present embodiment, the internal sphere 10 is made of a plurality of elastic layers, wherein the plurality of elastic layers includes a first elastic layer 151 and a second elastic layer 152. The first elastic layer 151 and the second elastic layer 152 are concentrically covered with each other to form the internal sphere 10, and the first elastic layer 151 and the second elastic layer 152 may be made of the materials having different elastic coefficients and weights, thereby enabling the luminous ball 1 of the present disclosure to have the same weight and elastic force as a regular baseball/softball.

Here, the number of the elastic layers shown in FIG. 8 is used as an exemplary embodiment, and the present disclosure is not limited thereto.

Figure 9:
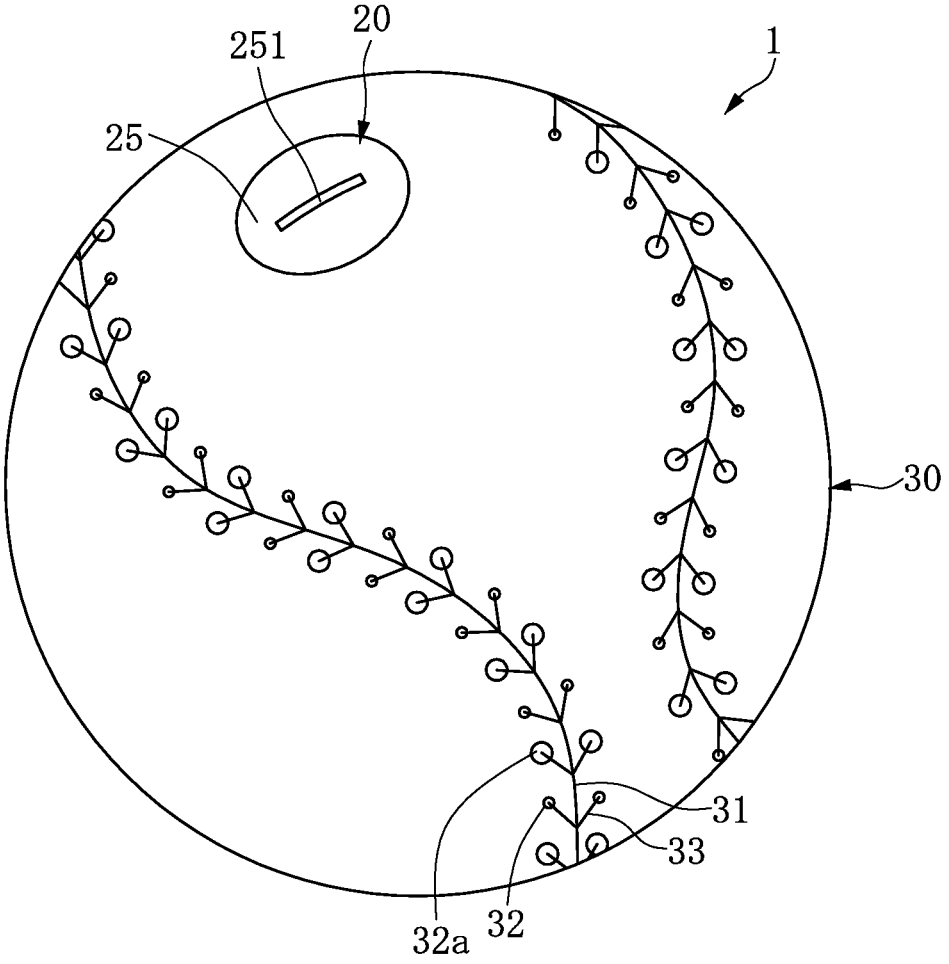
FIG. 9 is a three-dimensional view of the sixth embodiment of the present disclosure.

FIG. 9 illustrates the sixth embodiment of the present disclosure. As shown in the figure, the plurality of the thread apertures 32 are partially replaced by a plurality of thread apertures 32*a*, wherein each of the thread apertures 32*a* has a bigger diameter than that of each of the thread apertures 32. The plurality of thread apertures 32*a* and the plurality of thread apertures 32 are disposed in pairs at the two sides of the seam 31 alternatively, so that the light which penetrates the plurality of thread apertures 32*a* is more than the plurality of thread apertures 32, thereby enabling the luminosity of the plurality of thread apertures 32*a* to be higher than that of the plurality of the thread apertures 32.

As shown in FIG. 9, the plurality of thread apertures 32*a* and the plurality of thread apertures 32 are disposed alternatively and proportionately (1:1). However, the present embodiment is used as an exemplary embodiment, and the present disclosure is not limited thereto. In practice, the proportion and the number of the plurality of thread apertures 32*a* and the plurality of thread apertures 32 can be disposed to be 1:2, 1:3 or according to the actual requirements. Alternatively, a partial area of the seam 31 can be selected to dispose the thread aperture 32*a* having a bigger diameter.

In summary, the luminous ball 1 of the present disclosure is similar to a regular baseball/softball in appearance. In addition, the light generated by the light-emitting device 20 is visible through the thread aperture 32 and the seam 31 disposed on the covering 30, thereby enabling the user to recognize and identify the motion trajectory and rotation path of the luminous ball 1 under reduced lighting conditions such as dim light at night. Thus the luminous ball provided by the present disclosure can be feasibly played after dusk in the evenings and is adapted to the night-time use.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A luminous ball similar to a baseball/softball in appearance, comprising:

an internal sphere having a hollow part therein;

a receiving space disposed in the internal sphere, wherein the receiving space penetrates the internal sphere from an outside of the internal sphere to an inside of the internal sphere and passes through the hollow part, wherein a top opening is formed on one end of the receiving space and exposed on the outside of the internal sphere, wherein a lower end of the receiving space is formed on another end of the receiving space and opposite to the top opening, wherein the top opening and the lower end of the receiving space are arranged on two opposite sides of the hollow part;

a light-emitting device disposed in the receiving space, a cap being disposed on a top end of the light-emitting device, and a lower connection part being disposed on a lower end of the light-emitting device, wherein the cap is fixed in the top opening of the receiving space, and the lower connection part is fixed in the lower end of the receiving space;

at least one covering of which ends are spliced to wrap an external circumferential surface of the internal sphere, at least one seam formed on an edge of the covering, and a plurality of thread apertures disposed on the covering and arranged in pairs at two sides of the at least one seam; and at least one thread penetrating the plurality of thread apertures to stitch the edge of the covering between the two sides of the at least one seam; and wherein the internal sphere is made of a light transmissive material, and a light emitted by the light-emitting device penetrates the internal sphere through the receiving space and is visible through the at least one seam and the plurality of thread apertures.

2. The luminous ball according to claim 1, wherein the seam and the thread are distributed on the covering in accordance with a meandering course of red threads distributed on a regular baseball/softball.

3. The luminous ball according to claim 2, wherein the internal sphere is made of a transparent elastic material.

4. The luminous ball according to claim 1, wherein an internal side surface of the hollow part is disposed with a plurality concave parts.

5. The luminous ball according to claim 2, wherein the internal sphere has at least two elastic layers having different elastic coefficients, and the at least two elastic layers are concentrically covered with each other to wrap the internal sphere.

6. The luminous ball according to claim 2, wherein the external circumferential surface of the internal sphere has at least one smooth surface and at least one rough surface adjacent to the at least one smooth surface, wherein the at least one smooth surface and at least one rough surface contact an inner side of the covering, the at least one smooth surface is distributed in accordance with the meandering course of the seam distributed on the covering and the rough surface is distributed on a surface area of the internal sphere where it is not covered by the smooth surface, a width of the at least one smooth surface at least covers a width of the seam and the thread aperture, and a roughness of the at least one rough surface is greater than that of the at least one smooth surface.

7. The luminous ball according to claim 2, wherein a part of the thread apertures has a diameter that is bigger than that of the remainder of the thread apertures.

8. The luminous ball according to claim 1, wherein the light-emitting device comprises a main body and a plurality of light-emitting diodes disposed at an external side of the main body.

9. The luminous ball according to claim 1, wherein the light-emitting device is a fluorescent luminous device.

* * * * *